US008754025B2

(12) United States Patent
Wiedemann et al.

(10) Patent No.: US 8,754,025 B2
(45) **Date of Patent: *Jun. 17, 2014**

(54) DOSAGE ELEMENT AND A METHOD OF MANUFACTURING A DOSAGE ELEMENT

(75) Inventors: Ralf Wiedemann, Mira (IT); Pavlinka Roy, Ludwigshafen (DE); Frederic Moreux, Barcelona (ES)

(73) Assignee: Reckitt Benckiser N.V., Hoofddorp (NL)

( * ) Notice: Subject to any disclaimer, the term of this patent is extended or adjusted under 35 U.S.C. 154(b) by 306 days.

This patent is subject to a terminal disclaimer.

(21) Appl. No.: 12/523,566

(22) PCT Filed: Jan. 17, 2008

(86) PCT No.: PCT/GB2008/000168

§ 371 (c)(1),
(2), (4) Date: Dec. 15, 2009

(87) PCT Pub. No.: WO2008/087426

PCT Pub. Date: Jul. 24, 2008

(65) Prior Publication Data

US 2010/0105596 A1 Apr. 29, 2010

(30) Foreign Application Priority Data

Jan. 18, 2007 (GB) ..... 0700925.1

(51) Int. Cl.

| | |
|---|---|
| ***C11D 17/04*** | (2006.01) |
| ***C11D 11/00*** | (2006.01) |
| ***C11D 17/00*** | (2006.01) |
| ***B08B 9/20*** | (2006.01) |

(52) U.S. Cl.

CPC ..... *C11D 17/041* (2013.01); *C11D 17/042* (2013.01); *C11D 17/0047* (2013.01); *C11D 11/00* (2013.01); *C11D 11/0023* (2013.01); *C11D 11/0035* (2013.01); *B08B 9/20* (2013.01)

USPC ..... 510/439; 510/220; 510/296; 134/25.2

(58) Field of Classification Search

CPC ..... C11D 17/041; C11D 17/042; C11D 17/0047; C11D 11/00; C11D 11/0023; C11D 11/0035; B08B 9/20

USPC ..... 510/220, 439, 296; 134/25.2

See application file for complete search history.

(56) References Cited

U.S. PATENT DOCUMENTS

| | | | | |
|---|---|---|---|---|
| 2002/0137652 | A1* | 9/2002 | Gressel et al. | 510/297 |
| 2002/0169092 | A1* | 11/2002 | Catlin et al. | 510/220 |
| 2008/0248989 | A1 | 10/2008 | Holderbaum | |

FOREIGN PATENT DOCUMENTS

| | | | |
|---|---|---|---|
| DE | 102006031337 | A1 | 1/2007 |
| EP | 1506925 | A1 | 2/2005 |

(Continued)

OTHER PUBLICATIONS

English language abstract of DE102006031337 found on esp@cenet.com.

(Continued)

*Primary Examiner* — Lorna M Douyon

(74) *Attorney, Agent, or Firm* — Norris McLaughlin & Marcus PA

(57) ABSTRACT

Dosage elements to be consumed in use in a ware washing machine are made by (a) forming a main container part within a cavity of a mold; (b) providing the main container part with a first substance; (c) adhering a second substance to the underside of a part which is to form a lid of the dosage element; and (d) sealing the lid-forming part to the main container part so as to close the main container part and enclose the first and second substances within it; wherein the second substance covers at least 5% of the free area of the lid-forming part.

9 Claims, 1 Drawing Sheet

(56) References Cited

FOREIGN PATENT DOCUMENTS

| | | | |
|---|---|---|---|
| EP | 1679362 | A1 | 7/2006 |
| GB | 2361686 | A | 10/2001 |
| GB | 2374580 | A | 10/2002 |
| GB | 2374581 | A | 10/2002 |
| GB | 2390840 | A | 1/2004 |
| WO | 0185898 | A1 | 11/2001 |
| WO | 0208380 | A1 | 1/2002 |
| WO | 0242408 | A2 | 5/2002 |
| WO | 2004014753 | A1 | 8/2003 |
| WO | 03072693 | A | 9/2003 |
| WO | 03072694 | A1 | 9/2003 |
| WO | 2004103849 | A1 | 12/2004 |
| WO | 2005121302 | A1 | 12/2005 |
| WO | 2005123511 | A1 | 12/2005 |
| WO | 2007116357 | A2 | 10/2007 |

OTHER PUBLICATIONS

English language abstract of EP1506925 found on esp@cenet.com.

* cited by examiner

DOSAGE ELEMENT AND A METHOD OF MANUFACTURING A DOSAGE ELEMENT

This is an application filed under 35 USC 371 of PCT/GB2008/000158.

This invention relates to a dosage element for a ware washing machine and to a method of manufacture thereof.

Ware washing machines, such as automatic clothes washing and dishwashing machines, typically utilise detergents and other additives in solid, liquid or powder form. These substances are either administered directly into the machine, or dispensed via a tray or a dedicated compartment system to be added to the washing area at the start of, or during, a washing cycle.

Often, the required detergents/additives are administered as a compound tablet comprising a plurality of active ingredients. These may be kept separate for reasons of incompatibility. Alternatively or additionally they may be kept separate so that they may be activated at different points during a washing cycle or rinsing cycle. This activation at a particular point may be achieved by including time and/or temperature dependent released elements within the substance. One technique involves the coating or encasing of individual active components of the compound tablet within a water soluble polymer or gel of given properties/thickness to provide a time delayed and/or temperature dependent exposure to the component within so that it is exposed to the wash liquor within the ware washing machine at the desired point in a cycle.

In compound dosage elements of the type described above, individual active components may be in any state such as a solid, particulate or liquid form.

With the need to accommodate perhaps three or four active components within a single convenient dosage element, comes the complication of isolating each component from its neighbours and providing the dosage form within an overall compact package. These issues lead to complications within the manufacturing process and an increase in the costs of production. Accordingly, it is one aim of preferred embodiments of the present invention to provide a relatively simple dosage element formation and uncomplicated method of construction.

Consumers are becoming increasingly reluctant to handle detergent substances directly as there are perceived health/hygiene issues to doing so. With this in mind, it is desired to provide a barrier between the hand of the consumer and the ingredients of the dosage element and to reduce the risks of inadvertent exposure of the consumer to active ingredients of the dosage element.

According to a first aspect of the invention, there is provided a method of manufacturing a dosage element to be consumed in use in a ware washing machine, the method comprising:

(a) forming a main container part within a cavity of a mould;
(b) delivering a first substance into the main container part;
(c) adhering a second substance to the underside of a part which is to form a lid of the dosage element; and
(d) sealing the lid-forming part to the main container part so as to close the main container part and enclose the first and second substances within it;

wherein the second substance covers at least 5% of the free area of the lid-forming part.

In this specification the "free area" of the lid-forming part is that area of the lid-forming part which is inward of the seal which is between the lid-forming part and the main container part.

The reference to "covering" at least 5% of the free area of the lid-forming part suitably denotes the "footprint" of the second substance. In certain embodiments there could be only partial contact and/or partial adhesion between the second substance and the lid-forming part. In such embodiments there is suitably adhesion over at least 50% of the footprint, preferably over at least 70%. In such embodiments there is suitably adhesion over up to 95% of the footprint, preferably over up to 85%.

Preferably, however, substantially the entire footprint of the second substance is in contact with the lid-forming part, and is adhered thereto.

Preferably the second substance covers at least 10% of the free area of the lid-forming part, preferably at least 15%.

Preferably the second substance covers up to 60% of the free area of the lid-forming part, preferably up to 40%, more preferably up to 30%.

In the present invention the dosage element is suitably consumed in a washing cycle, in the sense that at the end of cycle no part of it has to be removed from the machine; indeed, preferably, no part of it can be discerned, within the machine.

Preferably the method includes the step of providing a vent in the lid-forming part. Preferably such a vent gives direct communication with the second substance.

By "giving direct communication with the second substance" we mean that the second substance is suitably adhered to the lid-forming part, so as to cover the vent. Any gas (including vapour) passing through the vent must come from, or through, the second substance.

The vent may be a permanently open vent or a self-opening valve-type vent (for example a slit), which opens when there is an internal overpressure, for example caused by gas evolution within the dosage element (which we call "off-gassing" herein). When there is off-gassing the valve-type vent is forced open to release the pressure, then closes again, when the pressure has equalized with the external pressure. A permanently open vent may be a simple hole in the lid-forming part. A self-opening valve-type vent may be the result of a hole having been formed in the lid-forming part, the material of the lid-forming part being such that it contracts (e.g. by material creep or recovery) to close the hole, and leave a valve-type vent; or it may be formed initially as a valve-type vent, for example by being formed as a slit.

Preferably when a hole is formed in the lid-forming part, whether it remains in that shape or contracts partially (to leave a smaller hole) or wholly (to form a valve-type vent), that hole as formed is of area preferably at least 0.2 $mm^2$, preferably at least 0.5 $mm^2$, and more preferably at least 1 $mm^2$; and, independently, is of area preferably up to 8 $mm^2$, preferably up to 5 $mm^2$, and more preferably up to 3 $mm^2$.

Off-gassing may come from partial degradation of components within the second substance and/or within the first substance. In particular when the dosage element contains a bleach a gas may unavoidably evolve. This could cause bulging and in extreme cases threaten the integrity of the dosage element. However even when the volume of gas is not very large and is not likely to have such a drastic effect, it is desirable to minimize the changes in chemistry within the dosage element. It is better to find a way of releasing the gas than to retain it inside the dosage element.

Another benefit of a vent, when provided, is in allowing a desired emanation product to be released; for example a fragrance.

When provided, a said vent may be formed in the lid-forming part prior to its sealing to the main container part, or it may be formed in the lid-forming part after its sealing to the main container part.

The second substance may or may not obtrude the vent, depending on the embodiment. When it does not there may be a space between the vent and the second substance. By such means gaseous communication between the second substance and the vent may be improved.

When the vent is formed after the sealing of the lid-forming part to the main container part the means which forms the vent may form a blind hole or well in the second substance. Said means may be a punch tool which may penetrate into the second substance.

Preferably, the second substance is in the form of a portion which has an upper (or contact) surface to which the lid-forming part conforms. Suitably, the upper surface may be substantially flat, to adhere to a correspondingly flat surface of the lid-forming part. Alternatively, the upper surface may be shaped, for example formed with a peak, indentation, ridge or trough. Suitably it may be concave or, preferably, convex (or outwardly curved). Whatever the shape of the upper surface it is preferred that the lid-forming part conforms to that shape as the portions are adhered thereto. To this end the lid-forming part is preferably formed of a material which is flexible, in the sense that it can adopt the shape of the upper surface of the second substance without being subject to forces acting to remove it therefrom, and restore it to its previous shape. Preferably the lid-forming part is a film (by which we mean to include herein a foil).

Preferably the portion comprised of the second substance has a flat upper (or contact) surface. The portion may, for example, be a sphere, frusto-sphere (including hemisphere), ovoid or frusto-ovoid (including hemi-ovoid). Most preferably the portion is a lozenge-shaped tablet, having two main sides. Preferably the main sides are substantially identical to each other. Preferably the main sides are mirror images of each other about a central plane of the portion. Preferably the main sides are polygonal (e.g. square, rectangular, triangular, pentagonal, hexagonal) or monogonal (i.e. one-sided, for example elliptical or circular—the portion being a disc-shaped tablet in the latter case, which is particularly preferred).

The second substance may be adhered to the lid-forming part preferably by means of an adhesive, preferably an aqueous liquid, preferably a PVOH solution or water. The adhesive may be applied to the second substance, or to the lid-forming part in the regions in which contact is required, or to both.

The main container part may be sealed to the lid-forming part preferably by means of an adhesive, preferably an aqueous liquid, preferably a PVOH solution or water. The adhesive may be applied to the main container part in the sealing regions, or to the lid-forming part in the regions in which contact is required, or to both. Alternatively they may be sealed together by any suitable means, for example by means of a further adhesive or by heat sealing. Other methods of sealing include infra-red, radio frequency, ultrasonic, laser, solvent (such as water), vibration and spin welding. If heat sealing is used, a suitable sealing temperature is for example 125° C. A suitable sealing pressure is readily selected by the person skilled in the art.

The main container part and the lid-forming part may each have a peripheral region, and the peripheral regions are preferably arranged face-to-face when the parts are brought together for closing of the dosage element. These regions are suitably the means by which the parts are joined. They are sealed to each other in face-to-face relation, in the finished dosage element. Thus, the dosage element suitably has a peripheral skirt, which represents the sealing zone.

Preferably, the second substance is in contact with the first substance. The second substance may project into the first substance. Preferably the first substance surrounds the free surface(s) of the second substance. There may be direct contact or the two substances may be separated by a water soluble polymeric wrapper or coating (e.g. spray coating) around the second substance.

Preferably the main container part and the lid-forming part are of water-soluble polymeric material(s). The materials thereof may be the same or different.

Water-soluble herein includes water-dispersible.

When a water-soluble polymeric material is provided around the second substance this may be the same of different as the other water-soluble polymeric materials described in this specification.

Suitable water-soluble polymeric materials for use in this invention are such that discs of 100 μm thickness and 30 mm diameter dissolve in 5 liters of water maintained at 50° C., under gentle stirring, in less than 30 minutes.

A water-soluble polymeric material for use herein may suitably be selected from the group comprising polyvinyl alcohols, polyvinyl alcohol copolymers, partially hydrolyzed polyvinyl acetates, cellulose derivatives (such as alkylcelluloses, hydroxyalkylcelluloses, salts, ethers and esters of alkylcelluloses and hydroxyalkylcelluloses, for example, hydroxypropylcellulose, hydroxypropylmethyl-cellulose and sodium carboxymethylcellulose); polyglycolides, polyglycolic, acids, polylactides, polylactic acids; polyvinyl pyrrolidines, polyacrylic acids or salts or esters thereof, polymaleic acids or salts or esters thereof, dextrins, maltodextrins, polyacrylamides, acrylic acid/maleic anhydride copolymers, including copolymers (which includes terpolymers), and blends. Optionally fillers, plasticisers and process aids may also be comprised in the formulation of a water-soluble polymeric material for use herein.

Preferred polymeric materials for are selected from the group comprising polyvinyl alcohols, polyvinyl alcohol copolymers, and partially hydrolyzed polyvinyl acetates. An especially preferred water-soluble polymeric material comprises a poly(vinyl alcohol).

The second substance may be a solid body, such as a tablet of compressed powder. It may comprise a gel, optionally surrounded by a skin or shell of a water-soluble polymeric material, preferably as defined above. It may comprise a capsule or pouch of any solid, gel or liquid material, optionally surrounded by a skin or shell of a water-soluble polymeric material, preferably as defined above.

The first substance may suitably comprise a liquid, or a flowable solid such as a powder, or a flowable or pumpable gel.

The main container part may suitably be formed by injection moulding or, preferably, thermo-forming. The lid-forming part is suitably formed by injection moulding, extrusion or calendering but is preferably an as-supplied film made by blowing or casting. For both parts the preferred methods employ thermo-forming of film materials.

Preferably, the container walls are of film or sheet material having a thickness of between 30 and 600 μm. When thermo-forming is used, the thickness is preferably in the range 30-250 μm, preferably 40-200 μm, preferably 50-150 μm. When injection moulding is used, the thickness is preferably in the range 200-600 μm, preferably 240-600 μm preferably 250-400 μm.

The lid-forming part is preferably a sheet or film, preferably a film of thickness in the range 30 to 100 μm, preferably 50 to 90 μm, preferably 60 to 75 μm.

Preferably the dosage element is not of squared-off, cuboid appearance and/or is preferably not rigid. Preferably is not box-like, in look or feel. Preferably it is of somewhat rounded, preferably pillow-like appearance, and/or is of compliant or "squashy" feel.

A preferred dosage form of the invention is a laundry washing tablet or, most preferably, a dishwashing tablet. We use the term tablet here to denote a body which can be handled by a consumer as a discrete element, for example as a unit dose. Preferably the first and second substances comprise laundry detergent compositions, or, especially, dishwashing detergent compositions.

Preferred components of a dishwashing tablet are as follows:

Bleaching Compounds

Any type of bleaching compound conventionally used in detergent compositions may be used according to the present invention. Preferably the bleaching compound is selected from inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Desirably the bleaching compound is present in the compositions in an amount of from 1 to 60 wt %, especially 5 to 55 wt %, most preferably 10 to 50% wt, such as 10 to 20% wt. When the compositions of the invention comprise two or more distinct regions, the amount of bleaching compound typically present in each can be chosen as desired although the total amount of the bleaching compound will typically be within the amounts stated hereinabove.

Builders

The detergent compositions may also comprise conventional amounts of detergent builders which may be either phosphorous based or non-phosphorous based, or even a combination of both types. Suitable builders are well known in the art.

If phosphorous builders are to be used then it is preferred that mono-phosphates, di-phosphates, tri-polyphosphates or oligomeric-polyphosphates are used. The alkali metal salts of these compounds are preferred, in particular the sodium salts. An especially preferred builder is sodium tripolyphosphate (STPP).

The non-phosphorous based builder may be organic molecules with carboxylic group(s), amino acid based compound or a succinate based compound. The term 'succinate based compound' and 'succinic acid based compound' are used interchangeably herein.

Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (3-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula;

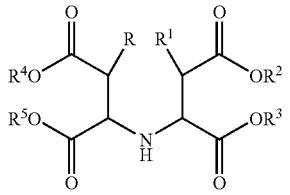

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium imminosuccinate.

Preferably the total amount of builder present in the compositions of the invention is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt %. The actual amount used will depend upon the nature of the builder used.

The detergent compositions of the invention may further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts.

Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate.

Correspondingly, a suitable hydroxycarboxylic acid is, for example, citric acid.

Another suitable polycarboxylic acid is the homopolymer of acrylic acid. Other suitable builders are disclosed in WO 95/01416, to the contents of which express reference is hereby made.

Surfactants

The detergent compositions of the invention may contain surface active agents, for example, anionic, cationic, amphoteric or zwitterionic surface active agents or mixtures, thereof. Many such surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred.

A preferred class of nonionic surfactants is ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles of ethylene oxide per mole of alcohol or alkylphenol.

Particularly preferred non-ionic surfactants are the non-ionics from a linear chain fatty alcohol with 16-20 carbon atoms and at least 12 moles particularly preferred at least 16 and still more preferred at least 20 moles of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_X[CH_2CH_2O]_Y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_X[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_XCH_2CH(OH)CH_2OR^2$$

The use of mixtures of different nonionic surfactants is suitable in the context of the present invention, for instance, mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt.

The surfactants are typically included in amounts of up to 15% wt, preferably of from 0.5% wt to 10% wt, such as 1% wt to 30.5% wt in total.

Anti-Foam Agents

The detergent composition according to the invention may comprise one or more foam control agents. Suitable foam control agents for this purpose are all those conventionally used in this field, such as, for example, silicones and paraffin oil. If present, the foam control agents are preferably present in the composition in amounts of 5% by weight or less of the total weight of the composition.

Anti-Corrosion Agents

It is known to include a source of multivalent ions in cleaning compositions, and in particular in automatic dishwashing compositions, for technical and/or performance reasons. For example, multivalent ions and especially zinc and/or manganese ions have been included for their ability to inhibit corrosion on metal and/or glass. Bismuth ions may also have benefits when included in such compositions.

For example, organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$. $CoSO_4$, Co $(NO_3)_2$ and $Ce(NO_3)_3$. Zinc salts are specially preferred corrosion inhibitors.

Therefore, an especially preferred optional ingredient according to the present invention is a source of multivalent ions such as those mentioned in the immediately preceding paragraph and in particular zinc, bismuth and/or manganese ions. In particular a source of zinc ions is preferred. Any suitable source of multivalent ions may be used, with the source preferably being chosen from sulphates, carbonates, acetates, gluconates and metal-protein compounds and those mentioned in the immediately preceding paragraph.

Any conventional amount of multivalent ions/multivalent ions source may be included in the compositions of the invention. However, it is preferred that the multivalent ions are present in an amount of from 0.01% wt to 5% wt, preferably 0.1% wt to 3% wt, such as 0.5% wt to 2.5% wt. The amount of multivalent ion source in the compositions of the invention will thus be correspondingly higher.

The detergent composition may also comprise a silver/copper corrosion inhibitor in conventional amounts. This term encompasses agents that are intended to prevent or reduce the tarnishing of non-ferrous metals, in particular of silver and copper. Preferred silver/copper corrosion inhibitors are benzotriazole or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Performance Polymers

Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. Suitable sulfonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %.

Enzymes

The detergent composition of the invention may comprise one or more enzymes. It is preferred that the enzyme is selected from protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. It is most preferred that protease enzymes are included in the compositions according to the invention; such enzymes are effective for example in dishwashing detergent compositions.

Desirably enzyme(s) is/are present in the composition in an amount of from 0.01 to 3 wt %, especially 0.1 to 2.5 wt %, such as 0.2 to 2 wt %.

Buffering Systems

The detergent composition according to the invention may comprise a buffering system to maintain the pH of the composition at a desired pH on dissolution and this may comprise a source of acidity or a source of alkalinity as necessary.

A source of acidity may suitably be any components which are acidic; for example polycarboxylic acids. Citric acid is especially preferred. Salts of these acids may also be used. A source of alkalinity may suitably be any suitable compound which is basic; for example any salt of a strong base and a weak acid such as soda. However additional acids or bases may be present. In the case of alkaline compositions silicates, phosphates or hydrogen phosphates may suitably be used. Preferred silicates are sodium silicates such as sodium disilicate, sodium metasilicate and crystalline phyllosilicates.

Perfume, Colours, Preservatives

The detergent compositions of the invention may also comprise minor, conventional amounts of perfumes, preservatives and/or colourants. Such ingredients are typically present in amounts of up to 2% wt.

Contrasting Parts

Preferred dosage forms have first and second parts which contrast with each other. They may contrast in the chemical nature of their components. The components may have different functions in a ware washing environment. They may be incompatible with each other. For example one component may interact adversely with another component to cause instability in storage or to reduce effective cleaning action, and such components may be segregated, one in the first part and one in the second part.

Alternatively or additionally the first and second parts may be arranged to release their components at different times in the washing process. This may be achieved by use of different coverings or skins for the components; for example by use of different wall materials for the first and second parts, with different rates of dissolution in the wash water and/or by use of walls of different thicknesses for the first and second parts.

Alternatively or additionally it may facilitate manufacture to separate certain components, and thereby create a contrast between the first and second parts.

Alternatively or additionally the first and second parts may contrast in their properties for aesthetic reasons. The following are examples of contrasting first and second parts:

an enzyme in one part and a bleach in another part;

a corrosion inhibitor in one part and a bleach in another part;

a corrosion inhibitor in one part and an enzyme in another part;

an acid or a hydrolysable agent in one part and an alkalinity agent in another part;

a solid (including a powder or a gel) in one part and a liquid in another part;

a solid (including a powder or a gel) in one part and another solid (including a powder or a gel) in another part, to be kept apart, whether for chemical/functional reasons or aesthetic reasons;

a liquid in one part and another liquid in another part, to be kept apart, whether for chemical/functional reasons or aesthetic reasons;

a pre-wash formulation (including a ware washing machine cleaner, for example machine sanitizer and/or descaler), in one part and a main wash formulation in another part;

a main wash formulation in one part and a rinse aid formulation in another part.

Preferably the components of a dosage element of the present invention may be expressed in terms of the following parts by weight:

100 parts of the first substance;

1 to 30 parts of the second substance, preferably 2 to 20, preferably 3 to 12, relative to the first substance;

0.2 to 5 parts of total water-soluble polymeric material(s), preferably 0.5 to 3, preferably 0.8 to 2.4, relative to the first substance.

Preferably the ratio by weight of the second substance to the total water-soluble polymeric material(s) is in the range 0.5:1 to 10:1, preferably 1:1 to 8:1, preferably 1.5:1 to 6:1.

Preferably the weight of the dosage element is at least 4 g, preferably at least 10 g, preferably at least 14 g.

Preferably the weight of the dosage element is up to 34 g, preferably up to 30 g.

Preferably the weight of the first substance is at least 3 g, preferably at least 9 g, preferably at least 15 g.

Preferably the weight of the first substance is up to 33 g, preferably up to 29 g.

Preferably the weight of the second substance is at least 0.1 g, preferably at least 0.25 g, preferably at least 0.4 g.

Preferably the weight of the second substance is up to 2.8 g, preferably up to 2 g, preferably up to 1.6 g.

Preferably the weight of the total water-soluble polymeric material(s) is at least 0.1 g, preferably at least 0.2 g, preferably at least 0.25 g.

Preferably the weight of the total water-soluble polymeric material(s) is up to 2 g, preferably up to 1 g, preferably up to 0.5 g.

Preferably; the mould comprises a plurality of cavities for forming a plurality of dosage elements at one time.

Preferably, in step (c) a plurality of portions of the second substance are adhered to the lid-forming part at spaced intervals corresponding to the spacings between cavities of the mould.

Preferably, step (d) comprises indexing the lid-forming part with the portions attached to it to a position in which each of the portions is in registration with a corresponding cavity in the mould, closing the cavities with the lid-forming part in this position and sealing the lid-forming part to the main container parts in the cavities. The method preferably comprises the step, in the mould or after removal from the mould, of separating the completed dosage elements into individual dosage elements or into groups of dosage elements, for example 4-16 in number, which are packaged in such groups and are intended to be separated into individual dosage elements by the user.

After the steps described above the dosage elements may be packaged.

Preferably the steps described above define the manufacturing method fully; that is, there is preferably no further substantive manufacturing step. In particular after step (d), there is for example preferably no step of setting the dosage elements face-to-face, for example by folding.

According to a second aspect of the invention, there is provided a dosage element to be consumed in use in a ware washing machine, the dosage element comprising a main container part and a lid-forming part sealed thereto, the dosage element includes first and second substances, the second substance being adhered to the underside of the lid-forming part and covering at least 5% of the free area of the lid-forming part.

The main container part and the lid-forming part may be of a water-soluble polymeric material. The second substance may be wrapped or coated in a water-soluble polymeric material. Such parts may be adhered or sealed together means of an adhesive, preferably an aqueous liquid, preferably water.

Preferably, the second substance is in contact with the first substance. The second substance may project into the first substance. Preferably the first substance surrounds the remaining surface(s) of the second substance. There may be direct contact or, as noted above, the two substances may be separated by a water soluble polymeric wrapper or coating (e.g. spray coating) around the second substance.

Preferably a vent is provided in the lid-forming part. Preferably the vent gives giving direct communication with the second substance.

The dosage element of the second aspect need not be made by the method of the first aspect. Nevertheless preferred aspects defined with reference to the first aspect may (unless not possible) be regarded as preferred aspects of the second aspect whether or not made by the method of the first aspect; and vice-versa.

However, the dosage element of the first aspect is preferably made by the method of the second aspect. In a third aspect of the invention there is provided a dosage element made by a method of the first aspect.

According to a fourth aspect there is provided a method of ware washing in a machine, preferably a method of washing kitchenware in a dishwashing machine, using a dosage element of the second aspect, or a dosage element of the third aspect.

For a better understanding of the invention, and to show how embodiments of the same may be carried into effect, reference will now be made, by way of example, to the accompanying diagrammatic drawings in which:

FIG. 1(*b*) is a schematic side-sectional view of that dosage-element, once formed.

Referring to the figures there will now be described a process for manufacturing a dosage element in accordance with an embodiment of the invention.

In the inventive process, there is provided a simple method of manufacture of a multi-component dosage element.

Dosage elements in accordance with the invention include a first substance held within a main container part, and a second substance. All wall materials are based on water-soluble polyvinyl alcohol (PVOH).

In accordance with the teachings of the present invention the second substance is adhered to the underside of a lidding film of the dosage element, so that the film which is used to close the main container part itself carries the second substance and encloses it within the dosage element.

Figure 1:
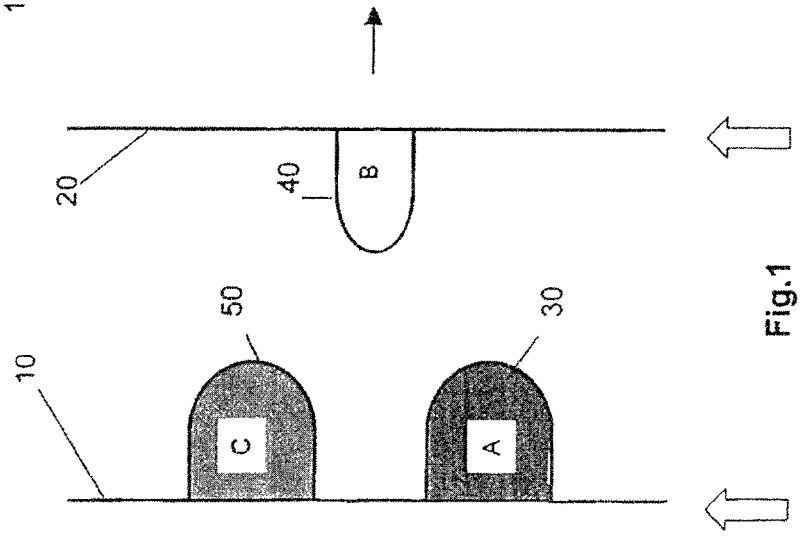
FIG. 1(*a*) is a schematic side-sectional view illustrating a step in the manufacture of a dosage element in accordance with a method of the invention.

Referring now to FIG. 1(*a*), there is shown a main container part 10, containing a first substance 40, being a dishwashing composition, and including an oxygen bleach, but no enzymes. There is also shown a lidding film 20, to the underside of which is adhered a portion 30 containing a second substance. The second composition is also a composition used in dishwashing, and contains enzymes, but no bleach.

The main container part 10 is manufactured by thermoforming a primary component (bottom film) as a tray of pockets in a thermoforming mould. A suitable forming temperature for PVOH-based polymeric materials is typically 120° C. The thickness of the film used to produce the pocket is 90 to 120 μm. A suitable forming vacuum is 0 to 2 kPa.

It will be seen that the main container part 10 is formed with an upwardly facing rim 15.

Following the thermoforming of the tray the first substance 40 is introduced into the pockets thereof.

The lidding film 20 has a plurality of portions 30 adhered to its underside, in regular spaced apart relation to one another. The adherence is achieved by using water as the adhesive. However, other adhesives such as glues, or HF sealing, could alternatively be used.

The thickness of the lidding film is in the range 60 to 75 μm.

It is important to ensure correct adherence across the portions 30 and, for this reason in this embodiment a top face of each portion 30 is substantially flat in order to maximise the contact area between lidding film 20 and portion 30. All of that flat top face is adhered to the lidding film, in this embodiment. However, it is envisaged that in some instances, a rounded profile to the portions 30 may be suitable to adhere to the lidding film, if the film were fed and adhered to the portions 30 when "warm and flexible" so as to wrap around and conform to the rounded outer profile of the portions 30.

Each portion 30 may be a solid, such as a compressed powder, a gel, a capsule or a pouch. Preferably it is a solid through which a gas may diffuse and/or is of a composition such as to release gas or vapour. It may be a fragrance-emanating composition.

With the portions 30 attached to the lidding film 20, the film may be indexed to the position shown in FIG. 1(*a*) and lowered to cover and close the main container part 10 in the mould as shown in FIG. 1(*b*). It will be seen that the lidding film makes contact with the upwardly facing rim 15 of the main container part. The rim is somewhat broad and this assists in achieving good sealing between the lidding film and the main container part.

Next, the tray of main container parts and the lidding film are sealed to one another. The parts may be sealed together by means of an aqueous solution of PVOH, acting as an adhesive. Alternatively they may be sealed together by any suitable means, for example by means of a further adhesive or by heat sealing. Other methods of sealing include infra-red, radio frequency, ultrasonic, laser, solvent (such as water), vibration and spin welding. If heat sealing is used, a suitable sealing temperature is for example 125° C. A suitable sealing pressure is readily selected by the person skilled in the art.

A punch tool have a matrix of punch needles may then be applied to punch a vent hole centrally through each lidding film, and part-way into the respective portion carried by the lidding film. The punch needles are cylindrical and of radius 0.8 mm.

The plurality of completed dosage elements may be ejected from the mould. This may be after separation of the dosage elements of the tray, within the mould, or may precede it. Separation of the dosage elements, wherever undertaken, may be into individual dosage elements or may be into groups of dosage elements, for example 4-16 in number, which are packaged in such groups and are intended to be separated into individual dosage elements by the user.

In this embodiment the ratio of the footprint of the portion 30 to the free area of the lidding film (that is, the area which is inward of the seal with the main container part; or in other words the area of the lidding film in which both faces are free from contact with the main container part) is 16% in this embodiment. In this embodiment the whole footprint is in contact with the lidding film, and the whole contact area is adhesively secured to the lidding film. Thus in this embodiment the footprint is the same as the area of adhesive contact between the secondary component and the lidding film.

The dosage element formed from the first and second parts is in the shape of a pillow. It is pleasant and feels "squashy" or compliant, rather than "rigid" or box-like. It is shape stable, in the sense that although it can be pressed and manipulated it does not lose its pillow shape.

It will be seen in FIG. 1(*b*) that the portion 30 is in contact on all exposed surfaces with the first substance 40.

Figure 5:
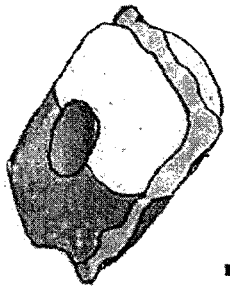
Figure 4:
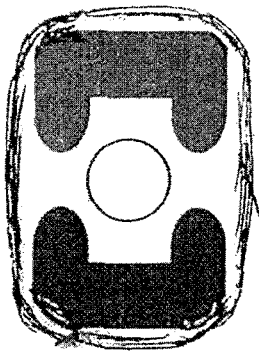
Figure 6:
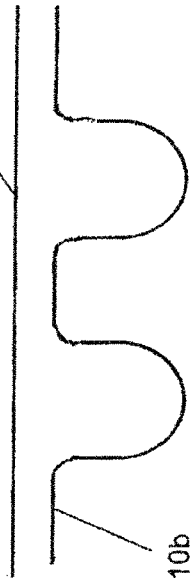
Figure 3:
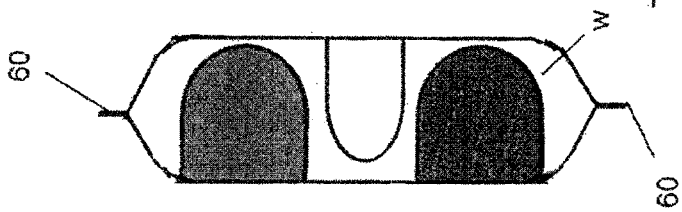
Figure 2:
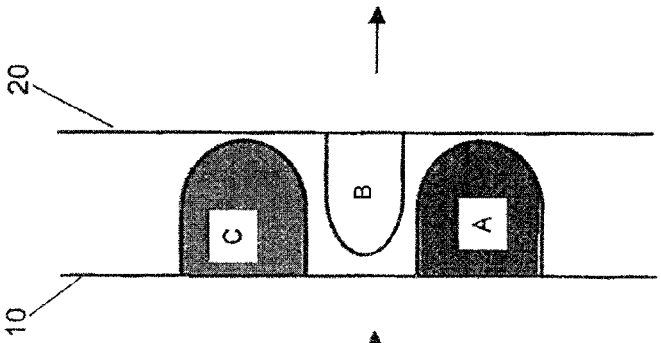
FIG. 2 is a schematic perspective view illustrating a second embodiment of dosage element produced in accordance with a method of the present invention.

A further example of a dosage element produced by this method is shown in FIG. 2. The footprint of the portion or "pill" is the same as the area of adhesive contact between the portion and the lidding film. In this embodiment the ratio of the footprint of the portion to the free area of the lidding film is 22%. In this embodiment the lidding film bulges in the upwards direction due to the complete filling of the container part 20 by dishwashing powder, prior to the introduction thereinto of the portion 30. The final form of the dosage element is thus a desired, compliant, pillow shape.

Suitable chemical compositions are as follows:

COMPOSITION EXAMPLE 1

A phosphate-containing powder composition (first substance) and a portion or "pill" is provided in one overall compartment (Table 1 below), for use in an automatic dishwashing machine. The portion is disc-shaped. The adhesion face is flat. The ratio of footprint (also of contact, in this embodiment) to free area of the lidding film is 12.5%. A vent hole is provided as described above.

TABLE 1

| Raw Material | Powder (19.0 g) | Portion (0.8 g) | Walls (0.4 g) |
|---|---|---|---|
| Sodium tripolyphosphate | 48.70 | | |
| Sodium carbonate | 16.00 | | |
| Sodium percarbonate | 16.00 | | |
| TAED | 6.00 | | |
| Phosphate speckles | 4.00 | | |
| Benzotriazol | 0.40 | | |
| HEDP 4 Na (88.5%) | 0.30 | | |
| Protease[1] | 1.50 | | |
| Amylase[1] | 1.00 | | |
| 1,2-Propylenediglycol | 1.00 | | |
| Perfume | 0.10 | | |
| Sulfonated polymer[2] | 5.00 | | |
| Gelatin | | 30.00 | |
| Water | | 19.95 | |
| Sulfonated polymer[2] | | 50.00 | |
| Dye | | 0.05 | |
| PVOH (bottom film)[7] | | | 75 |
| PVOH (top film)[8] | | | 25 |
| | 100 | 100 | 100 |

COMPOSITION EXAMPLE 2

A phosphate-containing powder composition (first substance) and a portion or "pill" are provided in one overall compartment (Table 2 below), for use in an automatic dishwashing machine. The portion is hemispherical. The adhesion face is flat. The ratio of footprint (also of contact, in this embodiment) to free area of lidding film is 24%. A vent hole is provided as described above.

TABLE 2

| Raw Material | Powder (19.0 g) | Portion (0.8 g) | Walls (0.3 g) |
|---|---|---|---|
| Sodium tripolyphosphate | 48.70 | | |
| Sodium carbonate | 16.00 | | |
| Sodium percarbonate | 16.00 | | |
| TAED | 6.00 | | |
| Phosphate speckles | 4.00 | | |
| Benzotriazol | 0.40 | | |
| HEDP 4 Na (88.5%) | 0.30 | | |
| Protease[1] | 1.50 | | |
| Amylase[1] | 1.00 | | |
| 1,2-Propylenediglycol | 1.00 | | |
| Perfume | 0.10 | | |
| Sulfonated Polymer[2] | 5.00 | | |
| Surfactant | | 44.95 | |
| Polyglycol 35000 | | 54.00 | |
| PVOH[9] | | 1.00 | |
| Dye | | 0.05 | |
| PVOH (bottom film)[7] | | | 67 |
| PVOH (top film)[8] | | | 33 |
| | 100 | 100 | 100 |

COMPOSITION EXAMPLE 3

A citrate-containing powder composition (first substance) and a portion or "pill" are provided in one overall compartment (Table 3 below), for use in an automatic dishwashing machine. The portion is disc-shaped. The adhesion face has a flat ring-shaped contact region around its circumference and a concave region inwards of that, in which the portion is not in contact with the lidding film. The ratio of the footprint of the portion to the free area of the lidding film is 25%. The ratio of the area of the contact region of the portion, across which adhesion is established, to the free area of lidding film, is 14%. A vent hole is provided as described above.

TABLE 3

| Raw Material | Powder (19.0 g) | Portion (0.8 g) | Walls (0.3 g) |
|---|---|---|---|
| Sodium citrate | 48.70 | | |
| Sodium carbonate | 16.00 | | |
| Sodium percarbonate | 16.00 | | |
| TAED | 6.00 | | |
| Phosphate speckles | 4.00 | | |
| Benzotriazol | 0.40 | | |
| HEDP 4 Na (88.5%) | 0.30 | | |
| Protease[1] | 1.50 | | |
| Amylase[1] | 1.00 | | |
| 1,2-Propylenediglycol | 1.00 | | |
| Perfume | 0.10 | | |
| Sulfonated Polymer[2] | 5.00 | | |
| Sulfonated Polymer[2] | | 20.00 | |
| PVOH composition[10] | | 79.95 | |
| Dye | | 0.05 | |
| PVOH (bottom film)[7] | | | 67 |
| PVOH (top film)[8] | | | 33 |
| | 100 | 100 | 100 |

COMPOSITION EXAMPLE 4

A phosphate-containing powder composition (first substance) and a pressed portion or "pill" are provided in one compartment (Table 4 below), for use in an automatic dishwashing machine. The "pill" is manufactured by compressing the portion formula with a compression force of 1200 kg/cm2 (diameter 13.0 mm; height 8 mm; weight 1.4 g). The "pills" are thereafter coated in a drum coater by spaying PVOH solution (10% in water) onto the pills. Each "pill" has the shape of a traditional medicinal pill, with opposed biconvex main surfaces spaced apart by a short cylindrical wall. The adhesion face is thus convex but full adhesive contact is obtained because the lidding film conforms to the convex shape. The ratio of the footprint of the portion to the free area of the lidding film is 19%. The ratio of the area of contact of the portion, across which adhesion is established, to the free area of lidding film, is 20%. A vent hole is provided as described above.

TABLE 4

| Raw Material | Powder (16.0 g) | Portion (1.4 g) | Walls (0.3 g) |
|---|---|---|---|
| Sodium tripolyphosphate | 48.70 | | |
| Sodium carbonate | 16.00 | | |
| Sodium percarbonate | 16.00 | | |
| TAED | 6.00 | | |
| Phosphate speckles | 4.00 | | |
| Benzotriazol | 0.40 | | |
| HEDP 4 Na (88.5%) | 0.30 | | |
| Protease[1] | 1.50 | | |
| Amylase[1] | 1.00 | | |
| 1,2-Propylenediglycol | 1.00 | | |
| Perfume | 0.10 | | |
| Sulfonated Polymer[2] | 5.00 | | |
| Lactose | | 20.00 | |
| Sodium CMC | | 18.00 | |
| Sodium bicarbonate | | 30.00 | |
| Citric acid | | 16.00 | |
| Protease[1] | | 8.00 | |
| HEDP 4 Na (88.5%) | | 2.00 | |
| Polyglycol | | 4.00 | |
| Mg-stearate | | 0.50 | |
| Dye | | 0.50 | |
| PVOH[9] | | 1.00 | |
| PVOH (bottom film)[7] | | | 67 |
| PVOH (top film)[8] | | | 33 |
| | 100 | 100 | 100 |

COMPOSITION EXAMPLE 5

A zeolite-containing powder composition (first substance) and a pressed portion or "pill" surrounded by a coating adhered to the top film (Table 5 below), are provided in one overall compartment for use in a laundry machine. The "pill" is manufactured by compressing the above portion formula with a compression of 1200 kg/cm2 (diameter 13.0 mm; height 8 mm; weight 1.4 g). The "pills" are thereafter coated in a drum coater by spaying PVOH solution (10% in water) onto the "pills". Each "pill" is spherical. Good adhesive contact is obtained because the lidding film conforms very well to the shape, over nearly a hemisphere thereof. The ratio of the footprint of the portion to the free area of the lidding film is 16%. The ratio of the area of contact of the portion, across which adhesion is established, to the free area of lidding film, is 29% (approaching double the ratio of the footprint to the free area of the lidding film in this embodiment, and indicates that nearly half of the spherical surface is in adhesive contact with the "pill"). A vent hole is provided as described above.

TABLE 5

| Raw Material | Powder (26.0 g) | Portion (1.4 g) | Walls (0.4 g) |
|---|---|---|---|
| LAS | 12.58 | | |
| Soap | 1.24 | | |
| Alkylsulfate | 2.27 | | |

TABLE 5-continued

| Raw Material | Powder (26.0 g) | Portion (1.4 g) | Walls (0.4 g) |
|---|---|---|---|
| Phosphonate | 0.58 | | |
| Polymer | 2.79 | | |
| Zeolite | 10.46 | | |
| Sodium carbonate | 26.81 | | |
| Sodium sulfate | 2.96 | | |
| Sodium silicate | 1.85 | | |
| Amorphous silicate | 8.75 | | |
| Antifoam substance | 0.47 | | |
| Polyethylenglycol | 0.15 | | |
| Amylase | 0.26 | | |
| Sodium percarbonate | 20.50 | | |
| Optical brightener | 0.29 | | |
| Fragrance | 0.26 | | |
| Water | 2.80 | | |
| TAED | 5.00 | | |
| Lactose | | 20.00 | |
| Sodium CMC | | 18.00 | |
| Sodium bicarbonate | | 30.00 | |
| Citric acid | | 16.00 | |
| Protease[1] | | 8.00 | |
| HEDP 4 Na (88.5%) | | 2.00 | |
| Polyglycol | | 4.00 | |
| Mg-stearate | | 0.50 | |
| Dye | | 0.50 | |
| PVOH[9] | | 1.00 | |
| PVOH (bottom film)[7] | | | 75 |
| PVOH (top film)[8] | | | 25 |
| | 100 | 100 | 100 |

In the above composition examples parts are by weight, and the following footnotes apply.

1 Granules which contain approx. 3-10% active enzyme

2 AMPS co-polymer

3 Non-ionic low foaming surfactant

4 Mixed poly alkoxylate grade, P 41/12000, Clariant

5 Silicon oil

6 PAP (phthalimidoperhexanoic acid) of particle size (Q50%<15 μm)

7 PVOH foil, 90 μm, PT grade from Aicello

8 PVOH foil, 60 μm, PT grade from Aicello

9 Low molecular weight PVOH surrounding the portion as coating

10 Composition comprising 85% of low molecular weight PVOH with a degree of hydrolysis being 85-88%; with 11% sorbitol and 4% processing aids.

In all examples above illustrating the present invention the dosage element is consumed in a washing 'cycle, in the sense that at the end of cycle no part of it has' to be removed from the machine; indeed no part of it can be discerned, within the machine.

The inventive method described above has a number of advantages.

One important advantage is that the second substance can be in contact with powder, or immersed in liquid, and thereby be supported. This in turn supports the lidding film to which it is attached, and supports the interface between the second substance and the lidding film. Thus, the portion 30 on the lidding film 20 may be arranged so as to reduce mechanical stresses in the completed dosage element.

Another important advantage is that the second substance can be surrounded by a liquid but still can be equipped with a venting hole (e.g. bleach, fragrance).

A further advantage is that the second substance 40 may be protected from moisture ingress even when there is a vent, by being surrounded by a coating which provides a moisture resisting barrier.

The portion 30 can work as an immobile spacer at a defined location. For example if it is deep it may prevent collapse of the opposed top and bottom walls, towards each other.

Where an adhesive is used to attach the portions 30, the make up of that adhesive may be manipulated to influence the film dissolution (delay or speed up).

Substance 30 could, if of suitable size, be used to separate ingredients within a dosage element.

The dosage element can be used to carry a liquid as the first substance and have the advantage of being leak safe, as the substance 30 serves as a barrier or "plug" preventing it from leaking out.

The invention claimed is:

1. A ware washing machine dosage element comprising first and second joined parts, wherein the first part comprises a substrate carrying a plurality of substances and wherein the second part comprises a substrate carrying one or more substances and wherein the first part is joined to the second part in peripheral areas thereof so as to form a closed receptacle enclosing said substances within it, wherein the substrate of the first part comprises a plurality of mutually separated substances arranged in side by side relation such that substances carried by the first substrate and the substance or substances carried by the second substrate mesh or interdigitate within the receptacle, wherein the substances are independently detergents or ware washing additives, and wherein the dosage element is a unit dose.

2. The dosage element of claim 1, wherein each of the first and second parts comprises respective first and second elements, wherein each second element comprises a pocket having one or more compartments for receiving a substance therein and wherein each first element closes the pocket formed by the respective second element such that each substance is enclosed within a respective compartment.

3. The dosage element according to claim 1, wherein the first part and the second part are flexible in isolation, but when joined to one another the dosage element formed is shape-stable.

4. A method of manufacturing a ware washing machine dosage element comprising the steps of:

(a) forming a first part into a substrate carrying a plurality of substances;

(b) forming a second part into a substrate carrying one or more substances; and (c) joining the first part to the second part in peripheral areas thereof so as to form a closed receptacle enclosing said substances within it, wherein in step (c) the first and second parts are arranged such that the first substrate carries a plurality of substances and comprises a plurality of mutually separated substances arranged in side by side relation such that substances carried by the first and second substrates mesh or interdigitate, wherein the substances are independently detergents or ware washing additives, wherein the dosage element is a unit dose.

5. The method of claim 4, wherein steps (a) and (b) each comprises the sub-steps of: (a1, b1) forming a pocket with one or more chambers; (a2, b2) introducing said substances to chambers of the pocket; and (a3, b3) sealing the chambers with a lid.

6. The method of claim 5, wherein sub-steps (a1, b1) each comprise: thermoforming a film of water-soluble polymeric substance within a cavity of the mould, and sub-steps (a3, b3) comprise: sealing the respective lids to the substrates in the moulds in which they were formed.

7. A dosage element manufactured by the method according to claim 4.

8. A method of ware washing comprising the steps of:

providing a dosage element according to claim 7 to a ware washing machine;

providing wares to be washed within the ware washing machine;

operating the ware washing machine to wash the wares.

9. The method according to claim 8, wherein the method is a dishwashing method practiced in an automatic dishwasher.

* * * * *

UNITED STATES PATENT AND TRADEMARK OFFICE

CERTIFICATE OF CORRECTION

PATENT NO. : 8,754,025 B2
APPLICATION NO. : 12/523566
DATED : June 17, 2014
INVENTOR(S) : Ralf Wiedemann et al.

It is certified that error appears in the above-identified patent and that said Letters Patent is hereby corrected as shown below:

Title Page

Item [86], the PCT No.:

"PCT/GB2008/000168" should read

-- PCT/GB2008/000158 --

Signed and Sealed this
Seventeenth Day of February, 2015

Michelle K. Lee

Michelle K. Lee
*Deputy Director of the United States Patent and Trademark Office*